US006626298B2

(12) United States Patent
Lax

(10) Patent No.: US 6,626,298 B2
(45) Date of Patent: Sep. 30, 2003

(54) HIGH SPEED BILL SORTER WITH PARALLEL DATA PROCESSORS

(75) Inventor: Jacob Lax, Brooklyn, NY (US)

(73) Assignee: Cashcan Corp., Brooklyn, NY (US)

( * ) Notice: Subject to any disclaimer, the term of this patent is extended or adjusted under 35 U.S.C. 154(b) by 0 days.

(21) Appl. No.: 09/859,304

(22) Filed: May 18, 2001

(65) Prior Publication Data

US 2002/0173874 A1 Nov. 21, 2002

(51) Int. Cl.[7] ..... B07C 5/00; B65H 3/52

(52) U.S. Cl. ..... 209/534; 209/900; 271/125; 271/137

(58) Field of Search ..... 209/534, 540, 209/900; 271/121, 125, 131, 137; 700/231

(56) References Cited

U.S. PATENT DOCUMENTS 3,771,783 A * 11/1973 McInerny ..... 271/125
3,933,350 A * 1/1976 Mignano ..... 271/125 X
4,690,268 A * 9/1987 Ueshin ..... 209/534 X
4,883,183 A * 11/1989 Kimura et al. ..... 209/534
4,894,783 A * 1/1990 Milne ..... 700/231

FOREIGN PATENT DOCUMENTS

JP 2-297296 * 12/1990 ..... 209/534

* cited by examiner

*Primary Examiner*—Tuan N. Nguyen
(74) *Attorney, Agent, or Firm*—Robert L. Epstein; Harold James; James & Franklin, LLP

(57) ABSTRACT

Bills are loaded into a hopper, separated and moved one at a time passed authentication sensors and an optical scanner. The sensors include a UV scanner, a magnetic sensor, an infrared scanner and a metallic thread detector. A main transport belt cooperates with first and second sensor transport belts to move the bills through the scanning section and into the bill collection section. The bill collection section includes multiple collection bins, each associated with a gate which, when actuated, guides a bill into the bin. A plurality of bill tracking sensors are located along the transport path. Data signals from the authentication sensors and the optical scanner for each bill are digitized and alternately routed to two parallel data processors. The processor outputs and tracking sensor outputs are fed to a control circuit which operates the collection bin gates and regulates the transport mechanism speed.

45 Claims, 9 Drawing Sheets

HIGH SPEED BILL SORTER WITH PARALLEL DATA PROCESSORS

CROSS-REFERENCE TO RELATED APPLICATIONS

Not Applicable

STATEMENT REGARDING FEDERACY SPONSORED RESEARCH OR DEVELOPMENT

Not Applicable

REFERENCE TO A "SEQUENCE LISTING"

Not Applicable

BACKGROUND OF THE INVENTION

1. Field of Invention

The present invention relates to automated currency authentication, counting and sorting apparatus and more particularly to a bill sorter which performs each of those operations in an efficient, versatile and high speed manner utilizing an improved mechanical transport system, multiple scanning devices for authentication and information reading and sophisticated digital signal processing including parallel 32-bit data processing units for increased speed and an 8-bit control circuit that tracks bills as they move through the apparatus, accurately regulates transport motor speed and operates the collection bin gates.

Many businesses such as banks, currency exchanges, retail establishments and the like receive large numbers of paper bills which must be authenticated, counted, sorted and bundled. While these tasks can be done manually, manual handling of the bills is time consuming, labor intensive and may result in inaccurate counts.

Moreover, the human eye is not capable of detecting certain features of the bill paper and/or the ink that are important to the authentication process. For example, the eye cannot detect magnetic particles in the ink. It cannot always see the fluorescence or reflective nature of the paper, the presence of infrared ink or the presence and type of metallic threads in the bill.

Clearly, there is a need for automatic apparatus to perform these functions. However, to be commercially successful, such apparatus must be first capable of recognizing which side (front or back) of the bill is being scanned and the orientation of the scanned side, that is, whether the scanned side is right side up or upside down, before the scanned information can be processed. It must be able to identify the denomination of the bill, in any of the four ways in which it is received, and to sort the bills by side and orientation, or by denomination, in addition to identifying and separating any bills that are counterfeit.

In order to accurately perform bill authentication, the apparatus must have multiple counterfeit detection abilities. Bills must be scanned to check for the presence of magnetic particles in the printed ink, the fluorescent and reflective nature of the paper, the use of infrared ink on the bill and to check for the presence and type of metallic threads in the paper.

The apparatus must also be able to read the serial number of the bill and convert the image into Optical Character Recognition digits which can be printed or stored electronically. It must be able to stack the sorted bills in pre-selected quantities. It must also be able to separate old type (pre-1996) bills from new type bills (after 1996).

The bill sorter of the present invention is capable of performing all of these functions in a high speed manner. This requires that the movement of the bills through the apparatus be closely tracked and that the transport system be accurately controlled. Further, it requires that the sorter be capable of processing the information scanned from the bills at a very high speed.

It is, therefore, a prime object of the present invention to provide a high speed bill sorter which utilizes parallel data processors.

It is another object of the present invention to provide a fully automated bill sorter which scans, authenticates, counts and sorts bills in an efficient, accurate and high speed manner.

It is another object of the present invention to provide a high speed bill sorter with parallel data processors that includes a plurality of tracking sensors located along the transport path and a digitally controlled bill transport system in which bills are monitored as they move through the apparatus and jams are detected, if same occur.

It is another object of the present invention to provide a high speed bill sorter with parallel data processors which can process bills on either side, whether oriented right side up or upside down.

It is another object of the present invention to provide a high speed bill sorter with parallel data processors capable of identifying the scanned side and orientation of the bills, and sorting the bills according to the side and orientation.

It is another object of the present invention to provide a high speed bill sorter with parallel data processors capable of sorting bills by denomination.

It is another object of the present invention to provide a high speed bill sorter with parallel data processors capable of scanning the serial number of the bill and converting the image into Optical Character Recognition digits that can be printed or stored electronically.

It is another object of the present invention to provide a high speed bill sorter with parallel data processors capable of sorting bills into batches of pre-selected quantities.

It is another object of the present invention to provide a high speed bill sorter with parallel data processors having multiple counterfeit detection capabilities.

It is another object of the present invention to provide a high speed bill sorter with parallel data processors capable of checking for magnetic particles in the print ink, checking for the presence of fluorescent and reflective properties in the paper, checking for the presence of infrared ink and checking for the presence and type of metallic threads in the bill.

It is another object of the present invention to provide a high speed bill sorter with parallel data processors capable of scanning and recording an optical image of the bill.

2. Description of Related Art

Not Applicable

BRIEF SUMMARY OF THE INVENTION

In accordance with the present invention, a bill sorting apparatus is provided. The apparatus includes means for receiving a bill. Means are provided for scanning each bill and for generating data signals which are a function of the information scanned. Multiple bill collection bins are provided. Transport means moves the bills, one at a time, along a transport path from the receiving means, through the scanning means, into one of the bill collection bins. Means are provided for digitizing the data signals. Means are provided for routing the digitized signals to one of the parallel data processors. Means control the transport means to move each bill into a collection bin selected in accordance with the output of the data processor receiving the digitized signals.

Preferably, the routing means alternately routes the digitized signals to the data processors. Thus, as digitized signals from one bill are being processed by one data processor, the digitized signals from the next bill are being routed to the other data processor for processing. This greatly increases the speed at which the sorter can operate.

The data signals are generated in an analog format. The digitizing means converts the data signals into a 32-bit digital format.

Each collection bin has an associated gate. The control means actuates the gate associated with the selected collection bin.

A plurality of bill tracking sensors are provided. The control means is connected to the bill tracking sensors.

The bill receiving means includes a hopper, picker means, prefeed means, and separator means. The picker means includes a picker roller with a surface which abuts the bills in the hopper as the picker roller rotates. The picker roller surface has a section with a raised surface portion. The raised surface portion of the picker roller covers approximately 10% of the picker roller surface.

The prefeed means includes a prefeed roller with a surface which abuts the bills in the hopper as the prefeed roller rotates. The prefeed roller surface has a section with a rubber element. The rubber element is adapted to engage the first bill in the hopper and move the engaged bill into the separator means. The rubber surface section covers approximately 25% of the prefeed roller surface.

The separator means includes a feed roller and a stripper roller, spaced apart by a gap through which the bill passes. Means are provided for driving the feed roller to rotate in one direction. Means are provided for preventing the stripper roller from rotating the opposite direction. The drive means also powers the picker roller and the prefeed roller. Means are provided for adjusting the gap between the feed roller and stripper roller.

The scanning means includes UV sensor means, magnetic sensor means, optical scanner means, infrared sensor means and metal thread sensor means.

The transport means includes first and second sensor transport belts. The first sensor transport belt extends passed the UV sensor means and the magnetic sensor means. The second sensor transport belt extends passed the infrared sensor means and metal thread sensor means. The optical scanner is located between the first and second sensor belts.

The transport means also includes a main transport belt. The main transport belt cooperates with the first and second sensor transport belts to move the bills passed the scanning means.

The gates are situated along the main transport belt. The gates divert bills from the main transport belt into the associated collection bin, when actuated by the control circuit. Each collection bin includes a stacker wheel and a pocket to retain bills. Means are provided for driving the stacker wheels.

The main transport belt includes a first transport section which passes through the scanning means, a second transport section which passes along the collection bins and means for connecting the first and the second transport sections. The connecting means includes a turnaround roller situated between the first transport section of the main transport belt and the second transport section of the main transport belt, around which the main transport belt extends. A turnaround belt is situated adjacent and cooperates with the turnaround roller.

The control means is operably connected to receive output signals from the data processors. The control means selects the collection bin in accordance with the output signals from the data processors.

A plurality of tracking sensors are located along the transport path. The tracking sensors are connected to the control means.

The transport means includes a motor which drives the main transport belt, a stacker drive motor associated with the collection bin stacker wheels and a feeder drive motor associated with the bill receiving means. The control means controls the speed of each of these motors.

Display means are operably connected to the data processors. The display means displays information scanned from the bill.

The digitizing means includes data signal amplification means, analog-to-digital converter means and buffer means. The buffer means is connected to the router means. First and second input/output interface means are operably interposed between the router means and the data processors.

The optical scanning means preferably takes the form of a CCD array scanner. The scanner reads and records an optical image of the bill surface. The scanner generates a data signal which is a function of the scanned image.

In accordance with another aspect of the present invention, bill sorting apparatus is provided including means for receiving a plurality of bills, means for scanning each bill and for generating data signals in accordance with the scanned information. Bill collection means are provided including a plurality of bill collection bins. Means process the data signals and select a collection bin in accordance therewith. Transport means move the bills, one at a time, along a first transport path section from the receiving means, through the scanning means to a second transport path section along the bill collection means and into the selected bin. The transport path sections are substantially parallel to each other.

Turnaround means are operably interposed between the first and second transport path sections. The transport means includes a main transport belt. The turnaround means includes a roller around which the main transport belt extends and a secondary belt situated proximate the roller.

Means are provided for driving the main transport belt. Control means regulate the driving means.

Bill tracking sensors are located along first transport path section. The bill tracking sensors are operably connected to the control means. Bill tracking sensors are also located along the second transport path section and are operably connected to the control means.

To these and to such other objects which hereinafter appear, the present invention relates to a high speed bill sorter with parallel data processors as described in detail in the following specification and recited in the annexed claims, taken together with the accompanying drawings, in which like numerals refer to like parts, and in which:

DETAILED DESCRIPTION OF THE INVENTION

Figure 1:
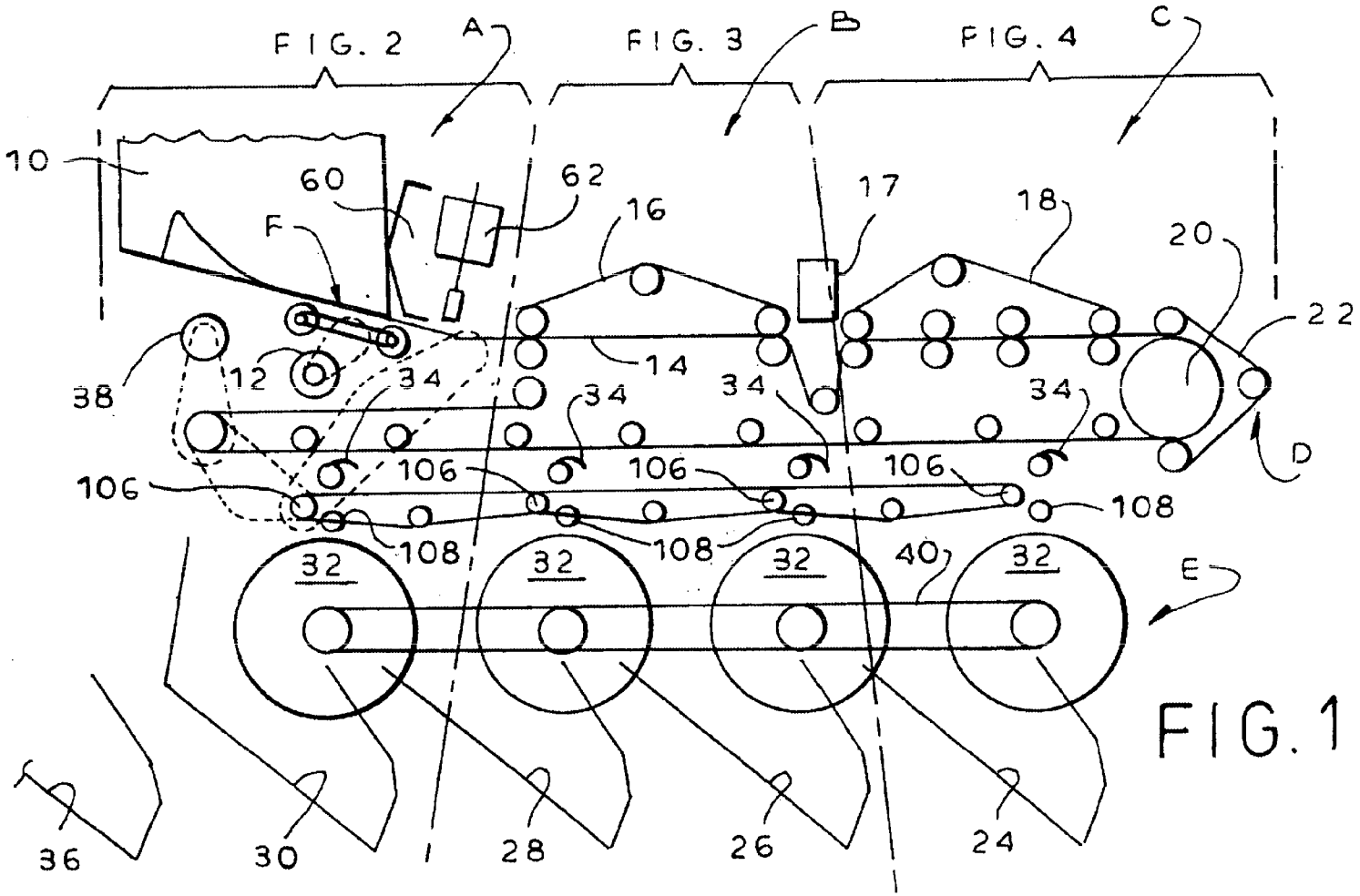
FIG. 1 is a simplified schematic drawing of the sorter of the present invention showing the bill receiving section, the bill scanning section, the bill collection section and transport belts.

As seen in FIG. 1, the high speed bill sorter of the present inventor includes a bill receiving section, generally designated A, a first bill scanning section, generally designated B, a second bill scanning section, generally designated C, a transport mechanism, generally designated D, and a bill collection section, generally designated E.

Bills are received in a stack in a hopper 10 of receiving section A. The bills are removed from the hopper, one at a time, moved through the scanning sections B and C, where they are scanned, by transport mechanism D and into bill collection section E, where the bills are guided to the appropriate bill collection bin.

The bills are placed in hopper 10, narrow edge forward. The bills can be situated in the hopper in any one of four ways: front side up, with the design either right side up or upside down, or back side up, with the design either right side up or upside down. The apparatus can scan and sort bills received in any of these four ways.

Bills are removed, one at a time, from hopper 10 by a separator mechanism, generally designated F, which is driven by a DC feeder motor 12. From separator F, the bill is inserted between the first section of a motor driven main transport belt 14 and an unpowered first sensor transport belt 16 which move the bill through the first scanning section B and passed the main optical scanner 17. The bill is then received between the first section of main transport belt 14 and an unpowered second sensor transport belt 18 which move the bill to a turnaround mechanism. The turnaround mechanism includes a turnaround roller 20 and a turnaround belt 22. Roller 20 cooperates with turnaround belt 22, which is unpowered, such that the bill follows the main transport belt 14 around roller 20, making a "U" turn around the roller, and heading back in the direction from which it came, along a second section of the main transport belt which extends through the bill collection section E.

The transport path is thus divided into first and second generally parallel transport path sections. The turnaround mechanism operably connects the transport path sections. By arranging the sections of the apparatus and the transport path in this configuration, the space required by the sorter is minimized and used efficiently.

Bill collection section E consists of four collection bins 24, 26, 28 and 30 and a discard bin 36. Each collection bin includes a rotatable stacker wheel 32 and a gate 34. As the bill travels along the second section of the path of belt 14 through the bill collection section, one of the gates 34 may be actuated to divert the bill from the belt toward the stacker wheel 32 associated with the actuated gate and into the collection bin pocket below the stacker wheel. In the event that none of the gates 34 are actuated, the bill will travel to the end of the second transport path section and be deposited into discard bin 36.

A DC motor 38 drives the main transport belt 14. A different DC motor (not shown) drives stacker roller belt 40 connected to each stacker wheel and hence all four stacker wheels 32 simultaneously. The feeder motor 12, main transport motor 38 and the stacker motor are each independently speed controlled by a control circuit 29, which also operates gates 34 to the collection bins.

As the bills move along the transport path, a series of twenty-one tracking sensors $S_1 \ldots S_{21}$, located at spaced locations along the transport path, detect the position of the bill and generate tracking signals to control circuit 29. Control circuit 29 tracks the movement of the bills and regulates the speed of the motors in accordance with those signals from the tracking sensors $S_1 \ldots S_{21}$.

Two 32-bit data processors 42, 44, connected in parallel, also provide input for control circuit 29. Control circuit 29 operates gates 34 in accordance with signals from the data processors. Control circuit 29 is preferably an 8-bit computer processor unit.

Processors 42, 44 receive information from the bill authentication scanners and the main optical scanner 17 in the scanner sections B and C through a data signal digitizing and routing circuit 140. The processors identify which of the four ways each bill is situated and can cause control circuit 29 to sort the bills on that basis into the four bill collection bins. The processors can also identify the denomination of the bill in any of the four ways it is situated and sort the bills by denomination into pre-selected bins. The bills in the collection bins can be stacked in pre-selected quantities from one to 100. Further, bills can be sorted into pre-1996 and post-1996 vintage, if required. Counterfeit bills are discarded.

Figure 2:
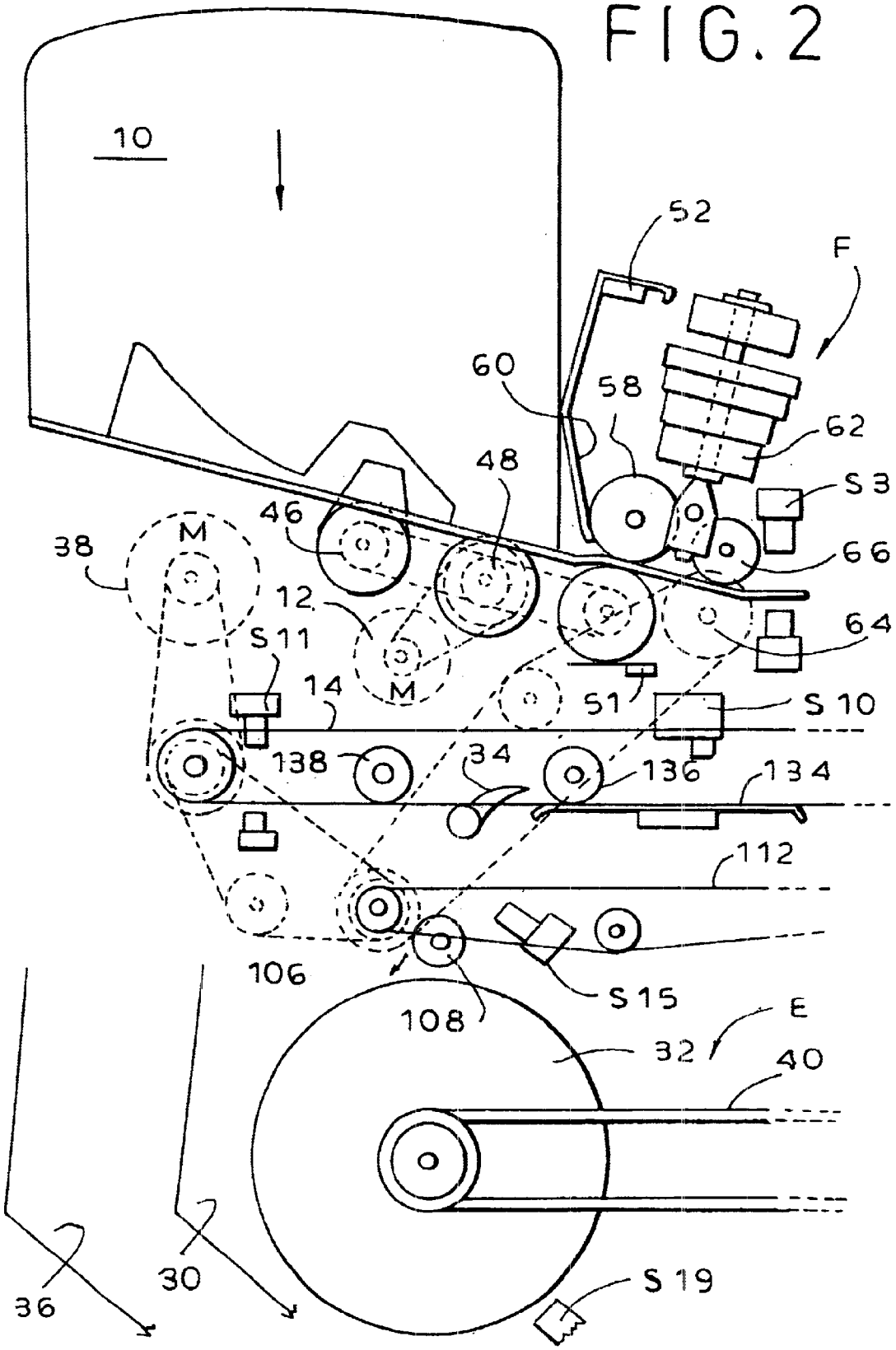
FIG. 2 is a detailed schematic drawing of the bill receiving section, collection bin and the discard bin.
Figure 9:
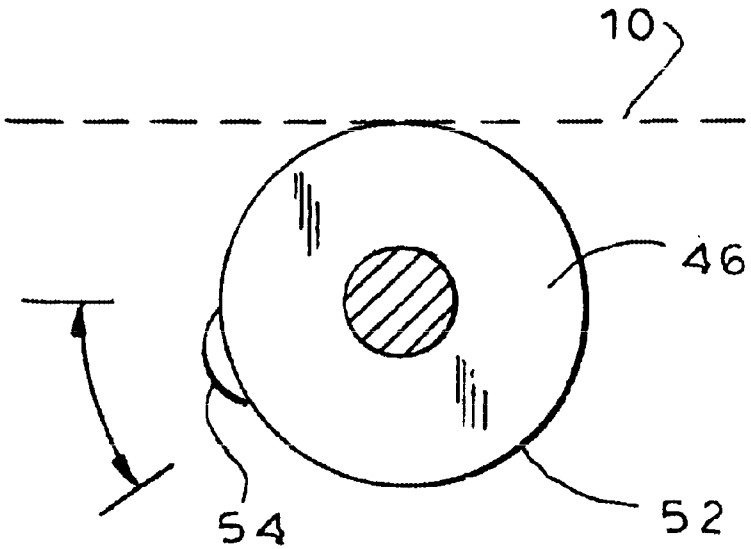
FIG. 9 is a side view of the picker roller.

FIG. 2 illustrates receiving section A which includes hopper 10, a picker roller 46, and a prefeed roller 48, driven by a DC motor 12. The picker roller 46, as seen in FIG. 9, has peripheral surface 52 with a raised section 54 which covers approximately 10% of the surface. This configuration allows the roller to act as an eccentric roller. While rotating, it bounces the bills up and down in the hopper, facilitating the bill separation process.

Figure 10:
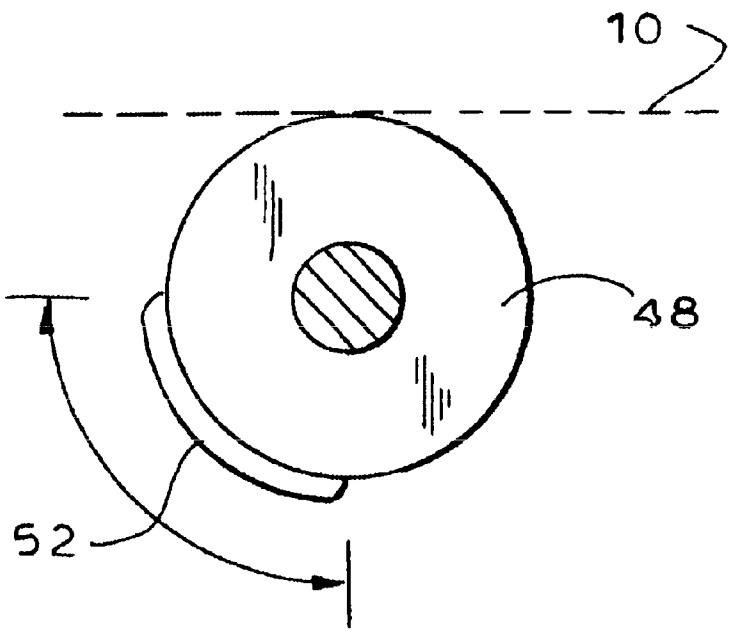
FIG. 10 is a side view of the prefeed roller.

The prefeed roller 48 has a smooth peripheral surface approximately 25% of which is covered by a rubber section 56, as seen in FIG. 10. When the rubber section 56 makes contact with the bottom of the bill in hopper 10, it causes the bill to move into the separator section F.

Separator section F includes a feed roller 50 and a stripper roller 58. Feed roller 50 is driven clockwise by motor 12, moving the bill towards the first scanning section B. The stripper roller 58 is not powered. It can freely rotate clockwise, but guide 60 prevents it from rotating in the opposite direction, such that only the bottom bill in the hopper is moved into the scanning sections.

Stripper roller 58 is mounted on a mechanism 62 which adjusts the gap between stripper roller 58 and feed roller 50. Immediately beyond mechanism 62 is a powered roller 64 which cooperates with an unpowered roller 66 to move the bill into first scanning section B, illustrated in FIG. 2.

As the bill enters the first scanning section B, the bill passes between main transport belt 14 and a first sensor transport belt 16 supported between rollers 68, 70, and through UV sensor 72 which senses the presence of fluorescent and reflective properties in the paper. Sensor 72 generates an analog data signal to control circuit 29. The bill, still between belts 14 and 16, passes between rollers 74, 76 and passed magnetic heads 78 which check for the presence of magnetic particles in the print ink. Heads 78 generate an analog data signal to the digitizing and routing circuit 140.

The bill then passes between rollers 80, 82 and proximate the main optical scanner 17, which is preferably a CCD array scanner. The analog data signal output from scanner 17 is connected to the digitizing and routing circuit 140. Scanner 17 preferably has 640 pixels which scan and record an optical image of the complete note. The serial number of the bill is converted into Optical Character Recognition digits which can be printed or stored electronically as a file.

Figure 4:
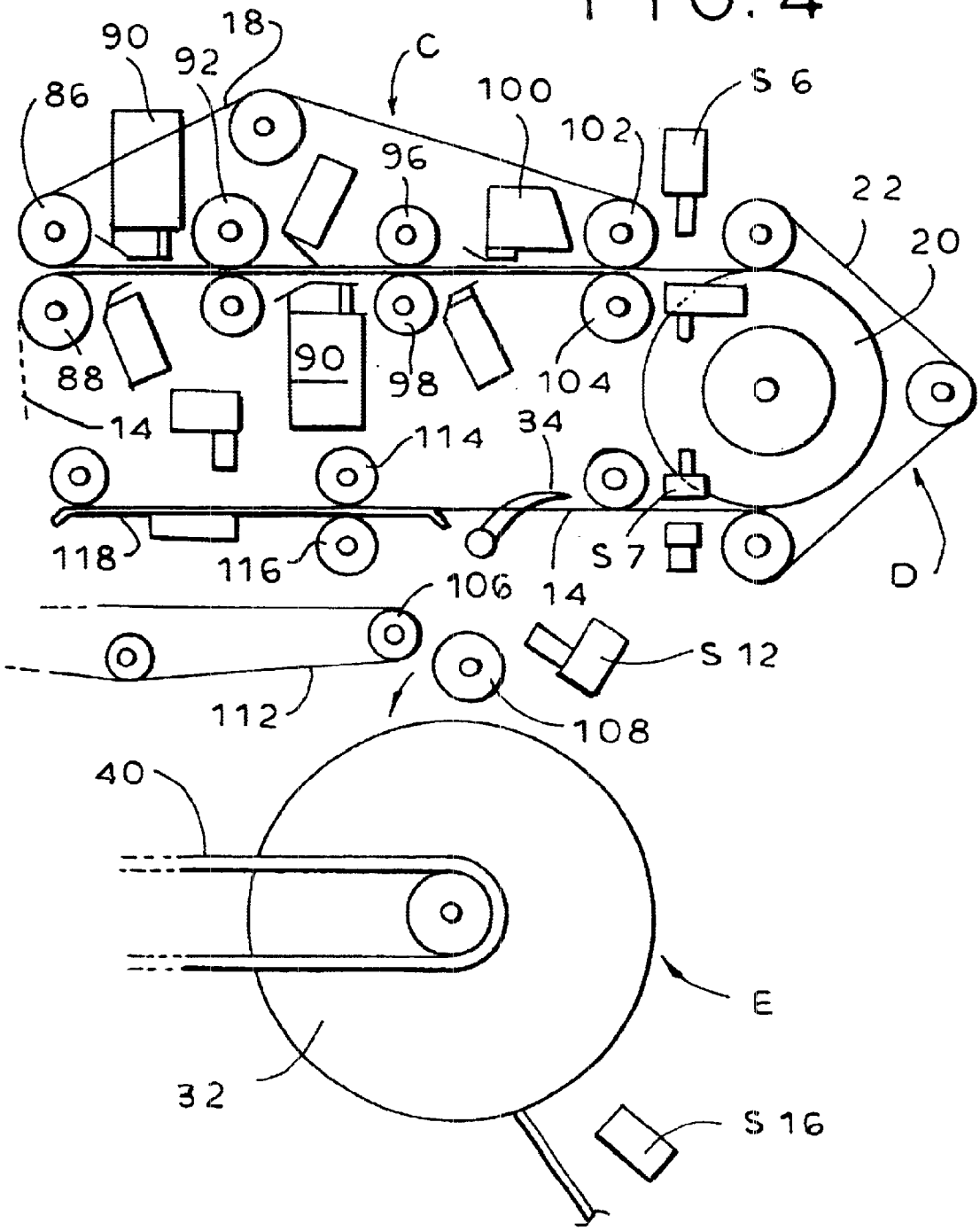
FIG. 4 is a detailed schematic drawing of the second scanning section, turnaround mechanism and a bill collection bin.

After the bill is read by scanner 17, it is moved into scanning section C, seen in FIG. 4. The bill enters between main transport belt 14 and unpowered second sensor transport belt 18 at rollers 86, 88 and passes two infrared scanners 90, one located on each side of the bill, which check for the presence of infrared ink on the bill. The analog data signal output of scanners 90 forms an input to the digitizing collection and routing circuit 140. The bill then passes between rollers 92, 94 and rollers 96, 98 and passed a metallic thread detector 100 which checks for the presence of metallic threads and the type of thread in the bill. The analog data output of detector 100 is sent to the digitizing collection and routing circuit 140 as well. The bill passes between rollers 102, 104 and into turnaround section, including turnaround roller 20 and belt 22.

The bill is now traveling along the second transport path section in a direction back toward hopper 10 and over the bill collection bins. If the bill encounters an actuated gate 34, which has been been rotated in a counterclockwise direction to an open position by the energization of an associated rotary solenoid, it is diverted from the main transport belt 14 downward between one of the sets of rollers 106, 108 and into the associated stacker wheel 32. Rollers 106 are driven by belt 112, which in turn is driven by the main transport motor 38.

Figure 5:
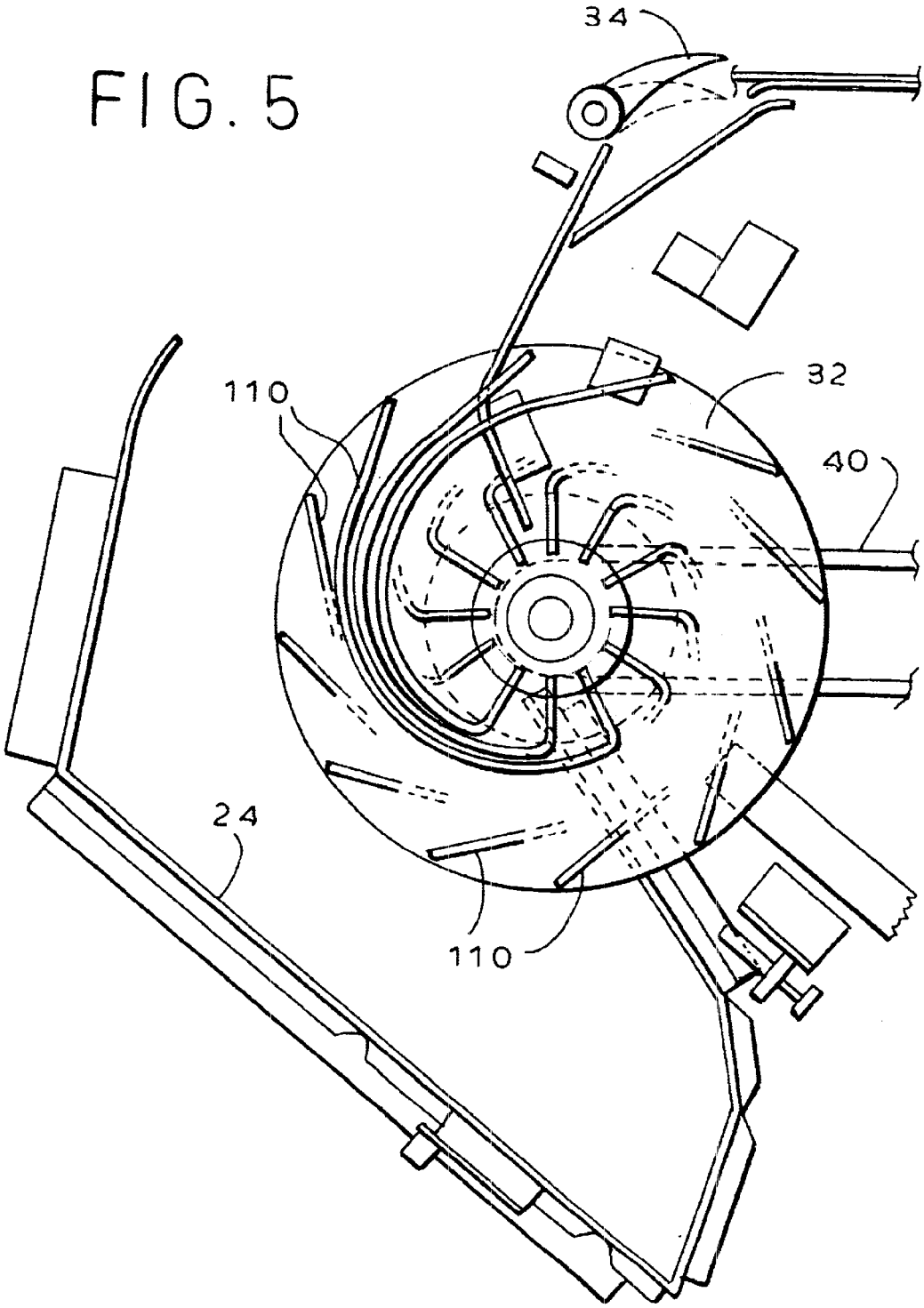
FIG. 5 is a detailed drawing of a typical bill collection bin.

A typical stacker wheel 32 and bill collection pocket 24 are illustrated in FIG. 5. The stacker wheel 32 includes a plurality of flexible elements 110 which help to push the bill into the collection pocket 24 as the wheel is rotated.

The bill will pass along the bill collection section, between rollers 114, 116, along guide 118 and roller 120. It then passes between rollers 122, 124 (FIG. 3), along guide 126 and roller 128, and between rollers 130, 132. The bill passes to guide 134 (FIG. 2) and roller 136. If none of the gates 34 have been actuated, the bill moves passed roller 138 and into discard bin 36.

Multiple bill tracking sensors $S_1 \ldots S_{21}$ are situated along the transport path. Sensors $S_1 \ldots S_{21}$ track the movement of the bills through the apparatus. Each of the sensors is connected to control circuit 29 which keeps track of the position of each bill. 74. As seen in FIG. 2, sensor $S_1$ is an optical switch located adjacent feed roller 50 to sense the feeder "home" position. Sensor $S_2$ detects when the hopper 10 is empty. Sensor $S_3$, at the feeder output, detects the leading edge of a bill and then the trailing edge of the bill, before the next bill is fed into the main transport system.

Figure 3:
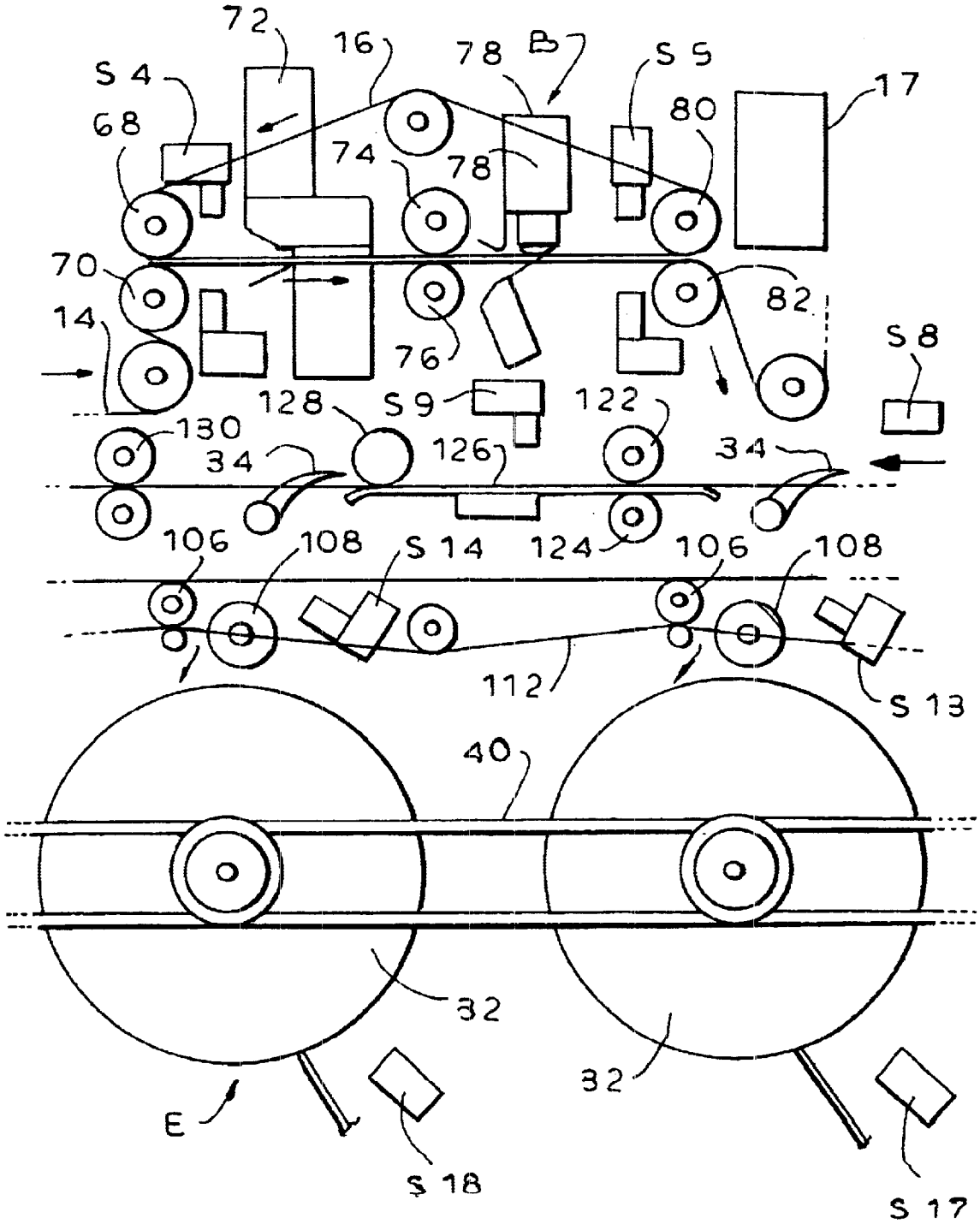
FIG. 3 is a detailed schematic drawing of the first scanning section and two of the bill collection bins.

As seen in FIG. 3, sensor $S_4$ is a multiple feed detector, sensing for double bill feeding. It also generates a signal which is used to start UV sensor 72. Sensor $S_5$ functions to start optical scanner 17.

As seen in FIG. 4, sensor $S_6$ detects the bill as it exits the second scanning section C and detects jams at that point. As seen in FIGS. 2, 3 and 4, sensors $S_7$ through $S_{10}$ are associated with the solenoids at gates 34, respectively. Sensor $S_{11}$ (FIG. 2) is the discard bin transport jam detection sensor. Sensors $S_{12}$ through $S_{15}$ are entry jam detection sensors for each of the collection bins. Sensors $S_{16}$ through $S_{19}$ are empty bin detector sensors. Sensor $S_{20}$ is not in use and sensor $S_{21}$ is a cover interlock sensor. Neither of the latter two sensors are shown in the drawings.

Figure 6:
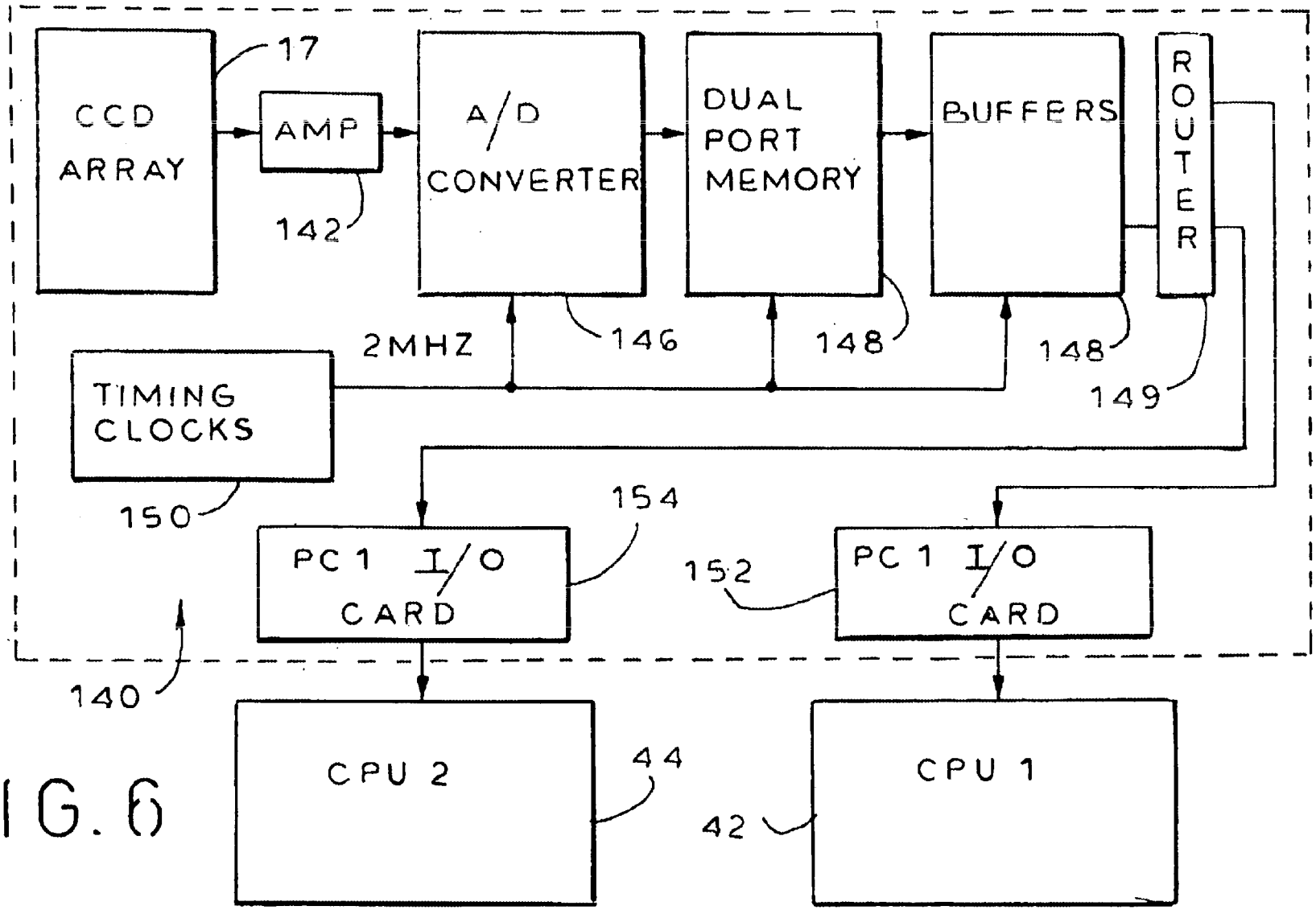
FIG. 6 is a block diagram of the data signal digitizing and routing circuitry.

FIG. 6 shows the parallel data processors 42, 44. Each is a 32-bit Pentium CPU board, preferably operating at 233 $MH_z$. Each processor is fed by the digitizing and routing circuit 140 which in turn receives data signals from optical scanner 17, thread detector 100, magnetic sensor 78 and infrared sensor 90.

Circuit 140 collects the analog data output signals, such as the data output signals from optical scanner 17 as illustrated in FIG. 6, and digitizes the data signals. The data signals from scanner 17 and other sensors are amplified in an amplifier 142 and then fed to an 8-bit analog-to-digital converter 144, such as a TLC 5510-INSLE. The digital output from converter 144 is received in a dual port memory 146 such as a CY7C131-15JC CYPRESS circuit and then passed through 8-bit buffers 148 such as 74 HCT 541. From the buffers, the digitized signals go to a router circuit 149 which selects which data processor the digitized signals are fed to. Clocks 150 (2 $MHz_z$) provide timing to the converter, memory, buffers and router.

The output of router 149 is a 32-bit signal which is sent to one of two 12 MB 32-bit PCI interface cards 152, 154 which in turn provide the signal inputs to processors 42 and 44, respectively. Preferably, router 149 routes the digitized data signals derived from every other bill a different one of the processors. For example, the digitized data signals from the first, third, fifth (odd numbered) etc. bills are fed to processor 42, whereas the digitized data signals derived from the second, fourth, sixth, (even numbered) etc. bills are fed to processor 44. Thus, when the first bill passes through the scanners, processor 42 receives the digitized data signals and processes them. While this is happening, the second bill in sequence is scanned and the digitized output signals from it are sent to processor 44 for processing. By then, processor 42 has completed analyzing the data signals from the first bill and is ready to accept the digitized signals from the next bill passing through the scanner array. Thus, processors 42 and 44, situated in parallel, receive digitized output data signals scanned from alternate bills and process them. This configuration greatly increases the speed at which the sorter can operate.

Figure 8:
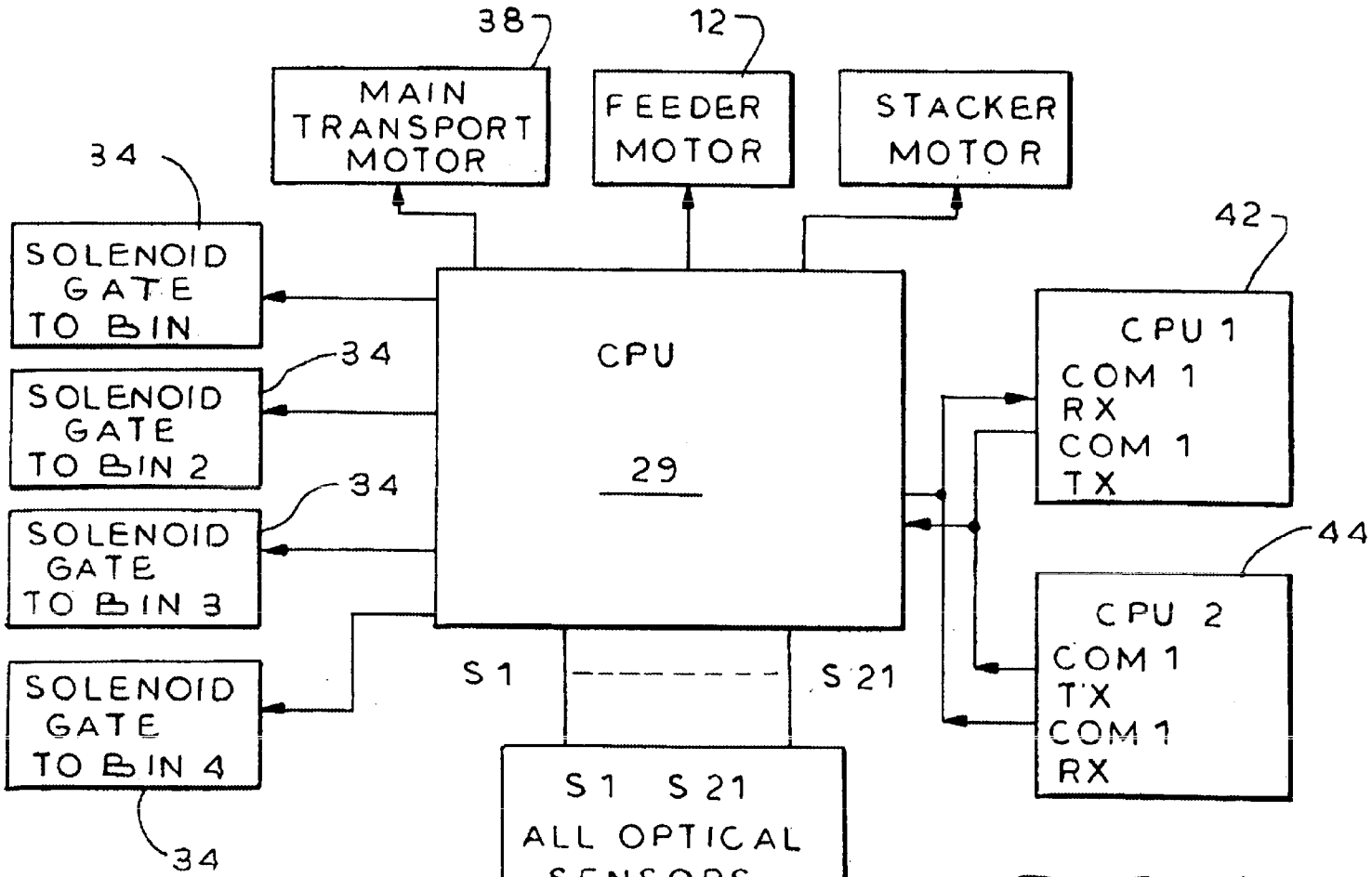
FIG. 8 is a block diagram of the control circuit.

As seen in FIG. 8, the control circuit 29 receives the outputs from both processors 42 and 44 and utilizes them, and the outputs from tracking sensors $S_1 \ldots S_{21}$, to operate gates 34 and individually control the voltage applied to each of the DC motors, including main transport motor 38, feeder motor 12 and the stacker motor (not shown).

Figure 7:
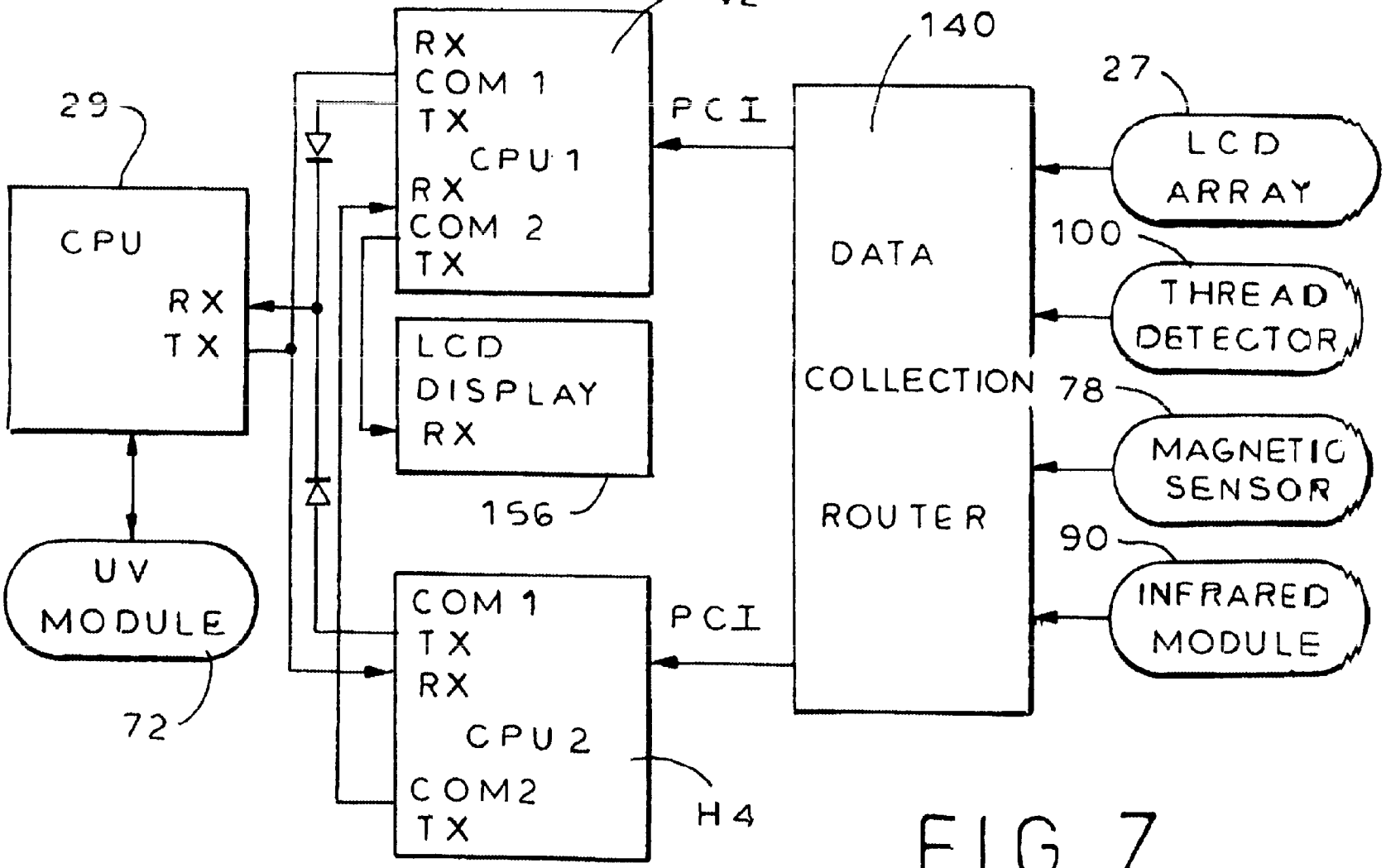
FIG. 7 is a block diagram showing the parallel data processing units.

In addition, processors 42, 44 send information, via a serial port, to a LCD display 156 (FIG. 7). Display 156 may provide a read out of scanned serial numbers, the bill count, the total value of sorted bills or information as to system status.

The sorter can be programmed to process different currencies and hence sort different bill sizes. It can accept bills between 119 mm and 175 mm in length and between 59 mm and 88 mm in width. U.S. bills are 165.5 mm long and 66 mm wide.

The nominal transport speed is 1,300 mm per second. Infrared sensors 90 are mounted both over and under the transport path to detect the presence of infrared on both sides of the bill. The metallic thread detector 100 can detect the presence of a metallic thread in any of the four ways the bill can be fed.

The input hopper can hold up to 400 bills. Each bill collection bin can hold up to 100 bills.

The speed of the main transport belt 14 and the speed of the hopper feeder motor are tracked by control circuit 29 so that the main transport motor speed cannot be slower than that of the feeder motor 12. This prevents jamming at the feeder section.

It will now be appreciated that the present invention relates to a high speed bill sorter capable of accepting and shorting bills in any one of four ways, of identifying and sorting bills by denomination, of scanning serial numbers for printing or storage and has multiple counterfeit detection capabilities. Parallel data processors process scanned information from alternate bills to increase the overall speed of the sorter. Bill collection bin gates operated by a control circuit which is connected to a plurality of tracking sensors and which regulates motor speed to avoid jams. The apparatus is compact due to parallel transport path sections.

While only a single preferred embodiment of the invention has been disclosed for purposes of illustration, it is obvious that many variations and modifications could be made thereto. It is intended to cover all of these variations and modifications which fall within the scope of the invention, as defined by the following claims:

I claim:

1. Bill sorting apparatus comprising means for receiving a plurality of bills, means for scanning each bill and for generating data signals in accordance with the scanned information, a plurality of bill collection bins, transport means for moving the bills, one at a time, along a transport path, from said bill receiving means, through said scanning means and into one of said collection bins, means for digitizing said data signals, first and second data processors, means for alternately selecting said data processors and for routing said digitized signals to said selected one of said data processors, and means for controlling said transport means to move bills into bill collection bins selected in accordance with the output of said data processor.

2. The apparatus of claim 1 wherein said selecting and routing means selects one of said first and second data processors and routes the digitized signals generated from scanning one bill to said selected data processor and then selects the other of said data processors and routes the digitized signals generated from scanning the next bill to said other of said data processors.

3. The apparatus of claim 1 wherein said data signals are in an analog format and wherein said digitizing means comprises means for converting said data signals to a digital format.

4. The apparatus of claim 3 wherein said digital format is a 32-bit format.

5. The apparatus of claim 1 wherein each of said collection bins has an associated gate and said control means actuates the gate associated with said selected output bin.

6. The apparatus of claim 1 further comprising a plurality of bill tracking sensors and wherein said control means is connected to said bill tracking sensors.

7. The apparatus of claim 1 wherein said receiving means comprises a hopper, picker means, prefeed means, and separator means.

8. The apparatus of claim 7 wherein said picker means comprises a picker roller with a surface which abuts the bills in said hopper as said picker roller rotates, said picker roller surface having a section with a raised surface portion.

9. The apparatus of claim 8 wherein said raised surface portion of said picker roller comprises approximately 10% of said picker roller surface.

10. The apparatus of claim 7 wherein said prefeed means comprises a prefeed roller with a surface which abuts the bills in said hopper as said prefeed roller rotates, said prefeed roller surface having a section with a rubber element, said rubber element being adapted to engage the first bill in said hopper and move said engaged bill into said separator means.

11. The apparatus of claim 10 wherein said prefeed roller surface section comprises approximately 25% of said prefeed roller surface.

12. The apparatus of claim 7 wherein said separator means comprises a feed roller and a stripper roller, spaced apart by a gap through which the bill passes, means for driving said feed roller to rotate in one direction and means for preventing said stripper roller from rotating in the opposite direction.

13. The apparatus of claim 12 further comprising means for adjusting said gap.

14. The apparatus of claim 8 wherein said prefeed means comprises a prefeed roller with a surface which abuts the bills in said hopper as said prefeed roller rotates, said prefeed roller surface having a section with a rubber element, said rubber element being adapted to engage the first bill in said hopper and move said engaged bill into said separator means.

15. The apparatus of claim 14 wherein said separator means comprises a feed roller and a stripped roller, spaced apart by a gap through which the bills pass, means for driving said feed wheel to rotate in one direction and means for preventing said stripper roller from rotating in the opposite direction.

16. The apparatus of claim 15 further comprising drive means, said drive means powering said picker roller and said prefeed roller.

17. The apparatus of claim 1 wherein said scanning means comprises UV sensor means.

18. The apparatus of claim 1 wherein said scanning means comprises magnetic sensor means.

19. The apparatus of claim 1 wherein said scanning means comprises optical scanner means.

20. The apparatus of claim 1 wherein said scanning means comprises infrared sensor means.

21. The apparatus of claim 1 wherein said sensor means comprises metal thread sensor means.

22. The apparatus of claim 17 wherein said transport means comprises first and second sensor transport belts.

23. The apparatus of claim 22 wherein said first sensor transport belt extends passed said UV sensor means.

24. The apparatus of claim 18 wherein said transport means comprises first and second sensor transport belts.

25. The apparatus of claim 24 wherein said first sensor transport belt extends passed said magnetic sensor means.

26. The apparatus of claim 20 wherein said transport means comprises first and second sensor transport belts.

27. The apparatus of claim 26 wherein said second transport belt extends passed said infrared sensor means.

28. The apparatus of claim 21 wherein said transport means comprises first and second sensor transport belts.

29. The apparatus of claim 28 wherein said second sensor transport belt extends passed said metal thread sensor means.

30. The apparatus of claim 1 wherein said transport means comprises first and second sensor transport belts.

31. The apparatus of claim 30 wherein said transport means further comprises a main transport belt, said main transport belt cooperating with said first and second sensor transport belts to move bills through said scanning means.

32. The apparatus of claim 5 wherein said transporting means comprises a main transport belt and wherein said gates are situated along said main transport belt, said gates diverting a bill from said main transport belt into the associated collection bin, when actuated by control means.

33. The apparatus of claim 1 wherein each of said collection bins comprises a stacker wheel and a pocket to retain bills.

34. The apparatus of claim 33 comprising means for driving each of said stacker wheels.

35. The apparatus of claim 1 wherein said transporting means comprises a main transport belt, said main transport belt having a first transport path section which passes through said scanning means, a second transport path section which passes along said collection bins and means for connecting said first and said transport path sections such that bills are moved from said first transport path section of said main transport belt to said second transport path section of said plain transport belt.

36. The apparatus of claim 35 wherein said connecting means comprises a turnaround roller situated between said first transport path section of said main transport belt and said second transport path section of said main transport belt around which said main transport belt extends and a turnaround belt situated adjacent said turnaround roller.

37. The apparatus of claim 1 wherein said routing means alternately selects a different one said data processors each time digitized signals associated with the next bill in sequence are received.

38. The apparatus of claim 1 wherein said control means controls said transport means.

39. The apparatus of claim 38 wherein said transport means comprises a transport motor and a feeder motor associated with said receiving means, and wherein said control means controls the speed of said main transport motor and said feeder motor.

40. The apparatus of claim 39 wherein said transport means further comprises stacker wheel means associated with each of said output collection bins, said stacker wheel means being driven by a stacker motor and wherein said control circuit controls said stacker motor.

41. The apparatus of claim 1 further comprising display means operably connected to said data processors.

42. The apparatus of claim 1 further comprising a plurality of bill tracking sensors located along said transport path, each of said bill tracking sensors being operably connected to said control means.

43. The apparatus of claim 1 wherein said digitizing means comprises data signal amplification means, analog-to-digital converter means and buffer means.

44. The apparatus of claim 1 wherein said routing means comprises first and second input/output interface means operably interposed between said buffer means and data processors.

45. The apparatus of claim 1 wherein said scanning means comprises a CCD array scanner which scans the bill surface and generates a data signal which is a function of the optical image of the bill.

* * * * *

UNITED STATES PATENT AND TRADEMARK OFFICE

CERTIFICATE OF CORRECTION

PATENT NO. : 6,626,298 B2
DATED : September 30, 2003
INVENTOR(S) : Jacob Lax

It is certified that error appears in the above-identified patent and that said Letters Patent is hereby corrected as shown below:

Title page,
Item [73], Assignee, should read -- CASHSCAN CORP. --.

Signed and Sealed this

Thirtieth Day of March, 2004

JON W. DUDAS
*Acting Director of the United States Patent and Trademark Office*